US008991953B2

(12) United States Patent
Lee et al.

(10) Patent No.: US 8,991,953 B2
(45) Date of Patent: Mar. 31, 2015

(54) REFRIGERATOR WITH DRAWER SEALING APPARATUS

(71) Applicant: LG Electronics Inc., Seoul (KR)

(72) Inventors: Jaeyoul Lee, Changwon-si (KR); Ayoung Choo, Changwon-si (KR); Daehyun Yoo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/029,043

(22) Filed: Sep. 17, 2013

(65) Prior Publication Data

US 2014/0077679 A1 Mar. 20, 2014

(30) Foreign Application Priority Data

Sep. 18, 2012 (KR) ..... 10-2012-0103534

(51) Int. Cl.

| | |
|---|---|
| ***A47B 96/04*** | (2006.01) |
| ***F25D 25/02*** | (2006.01) |
| ***F25D 23/08*** | (2006.01) |
| ***E05B 65/00*** | (2006.01) |
| ***E05B 65/46*** | (2006.01) |
| ***E05C 19/02*** | (2006.01) |

(52) U.S. Cl.

CPC ..... *F25D 25/025* (2013.01); *F25D 23/087* (2013.01); *E05B 65/0042* (2013.01); *E05B 65/46* (2013.01); *E05C 19/02* (2013.01)

USPC ..... 312/404; 312/333

(58) Field of Classification Search

CPC ..... A47B 2210/17; A47B 2210/175; F25D 25/025

USPC ..... 312/402, 404, 405, 332.1, 333

See application file for complete search history.

(56) References Cited

U.S. PATENT DOCUMENTS

| | | | | |
|---|---|---|---|---|
| 6,170,276 | B1 * | 1/2001 | Mandel et al. | 62/187 |
| 8,052,235 | B2 * | 11/2011 | Kelly et al. | 312/404 |
| 8,590,993 | B2 * | 11/2013 | Lee et al. | 312/404 |
| 2008/0148765 | A1 * | 6/2008 | Barone et al. | 62/407 |
| 2009/0007608 | A1 * | 1/2009 | Lorek | 70/144 |
| 2010/0257891 | A1 * | 10/2010 | Park | 62/449 |

FOREIGN PATENT DOCUMENTS

| | | | |
|---|---|---|---|
| JP | H05317142 | A | 12/1993 |
| KR | 2020000011249 | | 6/2000 |
| KR | 1020120006630 | A | 1/2012 |

* cited by examiner

*Primary Examiner* — Daniel Rohrhoff

(74) *Attorney, Agent, or Firm* — McKenna Long & Aldridge LLP

(57) ABSTRACT

A refrigerator having a drawer sealing apparatus includes a refrigerator main body having a cooling chamber, a case disposed within the cooling chamber and forming an accommodation space with a front opening, a drawer accommodated in the case and having a drawer door for opening and closing the front opening of the case, and a sealing apparatus comprising a drawer side member disposed on the drawer door and a case side member disposed on the case, the sealing apparatus having a sealing position where the drawer side member and the case side member are engaged with each other to maintain a sealed state when the drawer door is closed, and an unsealing position where the engaged state is released when the drawer door is open.

10 Claims, 10 Drawing Sheets

REFRIGERATOR WITH DRAWER SEALING APPARATUS

CROSS-REFERENCE TO RELATED APPLICATION

Pursuant to 35 U.S.C. §119(a), this application claims the benefit of earlier filing date and right of priority to Korean Application No. 10-2012-0103534, filed on Sep. 18, 2012, the contents of which is incorporated by reference herein in its entirety.

BACKGROUND OF THE DISCLOSURE

1. Field of the Disclosure

This specification relates to a refrigerator with a drawer sealing apparatus, and more particularly, to a refrigerator with a sealing apparatus disposed in a drawer, capable of preventing a deteriorated level of seal in a closed state of the drawer generally used as a vegetable chamber.

2. Background of the Disclosure

As is well known, a refrigerator is an apparatus for storing foods in a frozen or refrigerated state so as to be maintained in a fresh state for an extended time.

The refrigerator may include a refrigerator main body having a cooling chamber, and a door for opening and closing the cooling chamber. The refrigerator main body may include a refrigerating cycle system for providing cold air into the cooling chamber.

FIG. 1 is a perspective view illustrating one example of the related art refrigerator, FIG. 2 is a perspective view illustrating a vegetable chamber of the related art refrigerator, FIG. 3 is a sectional view illustrating a closed sealed state of a drawer door and a case, FIG. 4 is a sectional view illustrating a gasket disposed on the drawer door, and FIG. 5 is an enlarged view of main parts of FIG. 3.

As illustrated in FIG. 1, the refrigerator may include a refrigerator main body 10 having a cooling chamber 20, and a cooling chamber door 30 for opening and closing the cooling chamber 20.

The cooling chamber 20 may include a freezing chamber 21 and a refrigerating chamber 22.

The cooling chamber door 30 may include a freezing chamber door 31 and a refrigerating chamber door 32 for opening and closing the freezing chamber 21 and the refrigerating chamber 22, respectively.

The refrigerating chamber 22 may include therein a plurality of shelves 41 partitioning the refrigerating chamber 22 in a vertical direction.

Meanwhile, the refrigerating chamber 22 may include therein a so-called vegetable chamber 50 for storing vegetables and/or fruits.

The vegetable chamber 50 may be provided in plurality.

Referring to FIG. 2, each vegetable chamber 50 may include a case 54 and a drawer 16 received in the case 54, which can be drawn out and received along back and forth directions with respect to the case 54.

The drawer 16 may include a drawer door 16*a* disposed on a front thereof for sealing the case 54.

Referring to FIG. 3, in the vegetable chamber 50 of the related art refrigerator, the inside of the vegetable chamber 50 may be sealed by a gasket G disposed along an edge of the drawer door 16*a*.

Referring to FIGS. 4 and 5, the gasket G may include a body part G1 fixed to the drawer door 16*a*, and a sealing part G2 contacting an edge of an opening of the case 43 to block external air.

However, in the vegetable chamber 50 of the related art refrigerator, when the drawer door 16 is closed on the case 54, the gasket G may come off due to impact or vibration of the vegetable chamber 50, which may make it difficult to completely seal the case 54, causing difficulty in maintaining the sealed state of the inside of the vegetable chamber 50.

SUMMARY OF THE DISCLOSURE

Therefore, to obviate the drawbacks of the related art, an aspect of the detailed description is to provide a refrigerator having a drawer sealing apparatus, capable of preventing a deterioration of vacuum sealing ability of an inside of a vegetable chamber due to a gasket between a case of the vegetable chamber and a drawer door coming off in a closed state of a drawer of the vegetable chamber.

To achieve these and other advantages and in accordance with the purpose of this specification, as embodied and broadly described herein, there is provided a refrigerator having a drawer sealing apparatus including a refrigerator main body having a cooling chamber, a case disposed within the cooling chamber and forming an accommodation space with a front opening, a drawer accommodated in the case to be drawn out, a drawer door for opening and closing the front opening of the case as the drawer is closed, and a sealing apparatus comprising a drawer side member disposed on the drawer door and a case side member disposed on the case.

The sealing apparatus may have a sealing position where the drawer side member and the case side member are engaged with each other to maintain a sealed state when the drawer door is closed, and an unsealing position where the engaged state is released when the drawer door is open.

The drawer side member may include a drawer fixing unit fixed to a lower portion of the drawer door, and a fixing hook disposed at the drawer fixing portion.

The case side member may include a case fixing holder fixed to a lower portion of the case, and a movable hook mounted on the case fixing holder to be hinge-rotated.

The movable hook may be rotated to be stopped by the fixing hook when engaged with the fixing hook in the sealing position, and rotated to be released from the fixing hook in the unsealing position.

The movable hook may also include a hook hinge fixed to the case fixing holder.

The movable hook may be rotated centering on the hook hinge as a shaft such that a stopping hook formed on an end portion of the movable hook couples to a stopping portion formed on the fixing hook.

The case side member may include a hinge shaft formed on one end thereof and fixed to the case fixing holder, and a telescopic member formed on the other end thereof and contactable with the movable hook.

The telescopic member may include a telescopic rod expanded in the sealing position and contracted in the unsealing position.

The movable hook and the telescopic member may include engagement curved portions, respectively, on contact portions therebetween, and the telescopic member may be rotated to be expanded and contracted in response to the hinge-rotation of the movable hook.

In accordance with another exemplary embodiment, the case side member may further include a spring configured to allow one end portion of the telescopic rod to be maintained in a contact state with the movable hook.

The telescopic rod may be mounted in the spring, and both ends of the spring may be locked at both end portions of the telescopic member to have an elastic restoring force in an expanding direction of the telescopic member.

In accordance with another exemplary embodiment, the telescopic member may include a movable hook pressing member configured to press the fixing hook to hinge-rotate the movable hook when being engaged into the sealing position.

The movable hook may include a rotation pressing protrusion pressed by the movable hook pressing member such that the movable hook is rotated centering on the hook hinge as a shaft.

Preferably, the movable hook pressing member may be an elastic bar having one end fixed to the hinge shaft of the telescopic member and the other end contactable with the rotation pressing protrusion.

In accordance with another exemplary embodiment, the case fixing holder may include a hook stopping jaw and the movable hook comprises a holder stopping jaw.

In accordance with those aspects of the present disclosure, by an operation of simply pressing a drawer toward a case for accommodation of the drawer, the drawer may be hermetically accommodated in the case and simultaneously the hermetic state may be maintained.

Also, for convenience of stopping and releasing a hook, a spring which applies an elastic restoring force in an expanding direction may be separately provided on a telescopic member, which may allow for conversion into a sealing position and an unsealing position even by a small force.

The present disclosure may also prevent a gasket, which is disposed between the case and the drawer, from coming off when a drawer door is closed, which may result in further improvement of a sealing performance of an inside of a vegetable chamber.

In addition, as components associated with an operation of the drawer are accommodated within the drawer, unexpected locking (restrictions) which may be caused due to those components being externally exposed may be minimized.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of a refrigerator having a drawer sealing apparatus according to the exemplary embodiments, with reference to the accompanying drawings.

Furthermore, the terms including an ordinal number such as first, second, and etc., can be used to describe various elements, but the elements should not be limited by those terms. The terms are used merely for the purpose to distinguish an element from the other element.

The accompanying drawings are used to help easily understood the technical idea of the present invention and it should be understood that the idea of the present invention is not limited by the accompanying drawings. The idea of the present invention should be construed to extend to any alterations, equivalents and substitutes besides the accompanying drawings.

Figure 1:
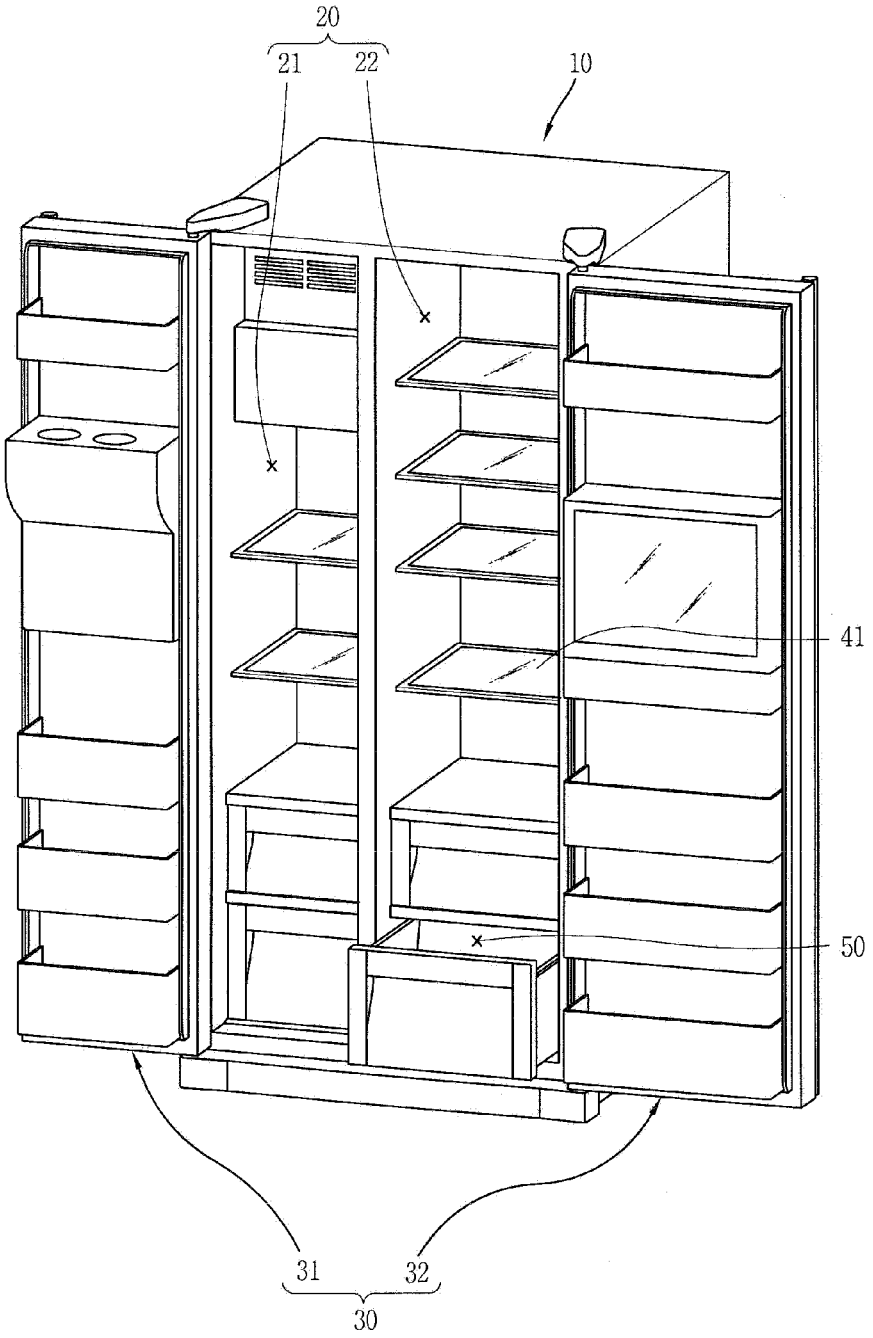
Figure 1 Related Art
FIG. 1 is a perspective view illustrating one example of a related art refrigerator.
Figure 2:
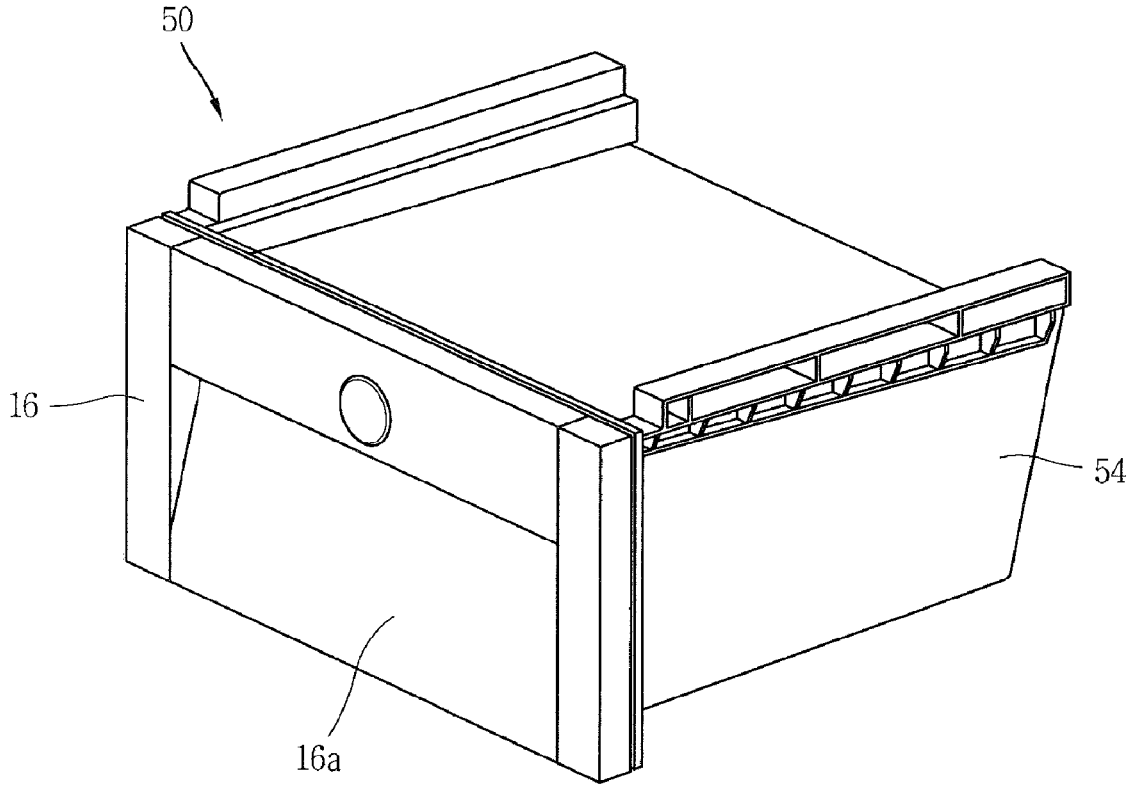
Figure 2 Related Art
FIG. 2 is a perspective view illustrating a vegetable chamber of the related art refrigerator.
Figure 3:
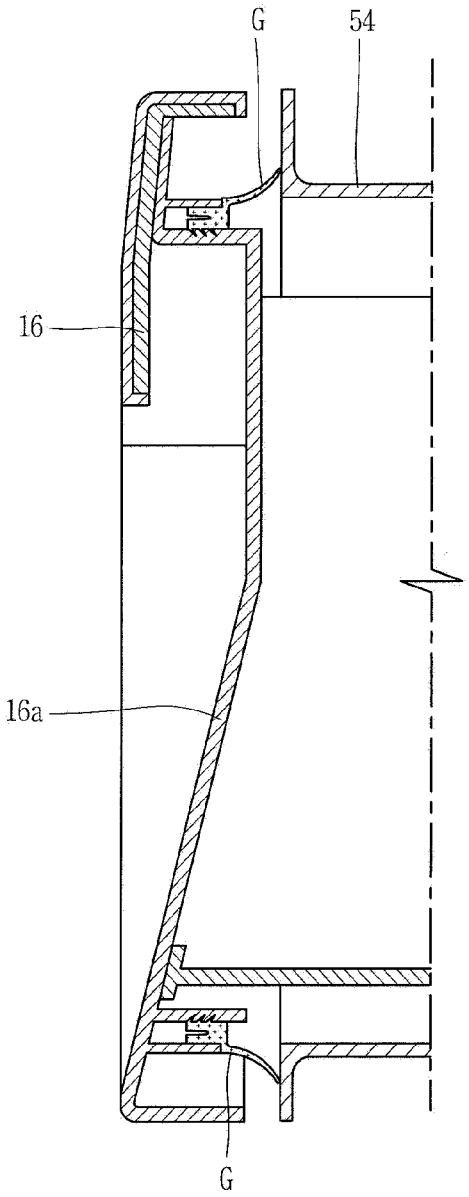
Figure 3 Related Art
FIG. 3 is a sectional view illustrating a closed state of a drawer door and a case illustrated in FIG. 2.
Figure 4:
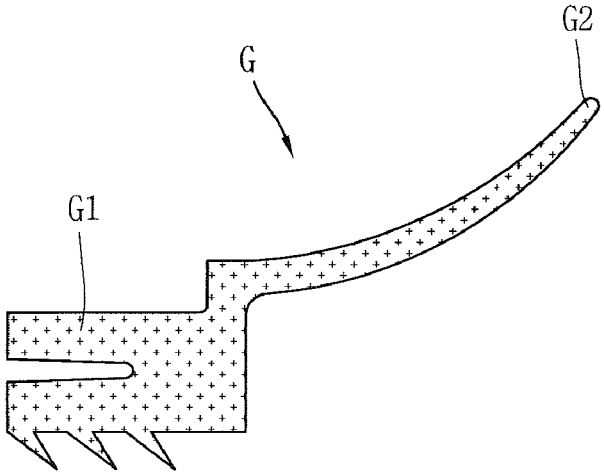
Figure 4 Related Art
FIG. 4 is a sectional view illustrating a gasket disposed on the drawer door of FIG. 3.
Figure 5:
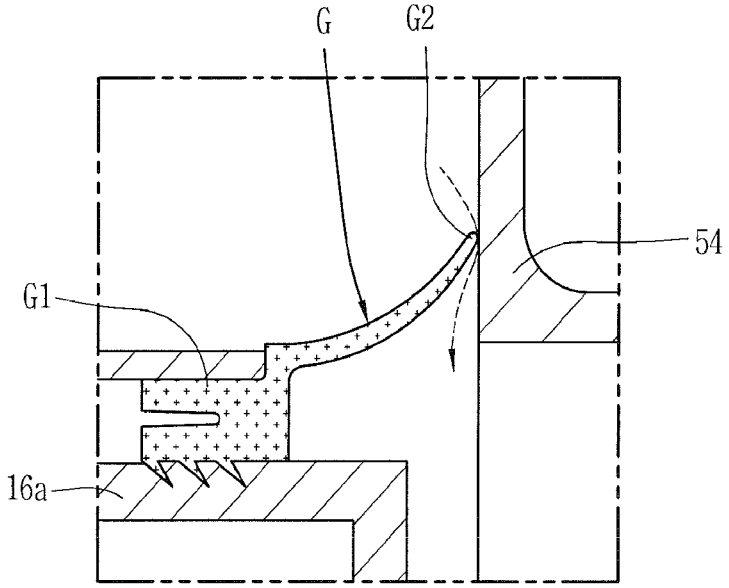
Figure 5 Related Art
FIG. 5 is an enlarged view of main parts of FIG. 3.
Figure 6:
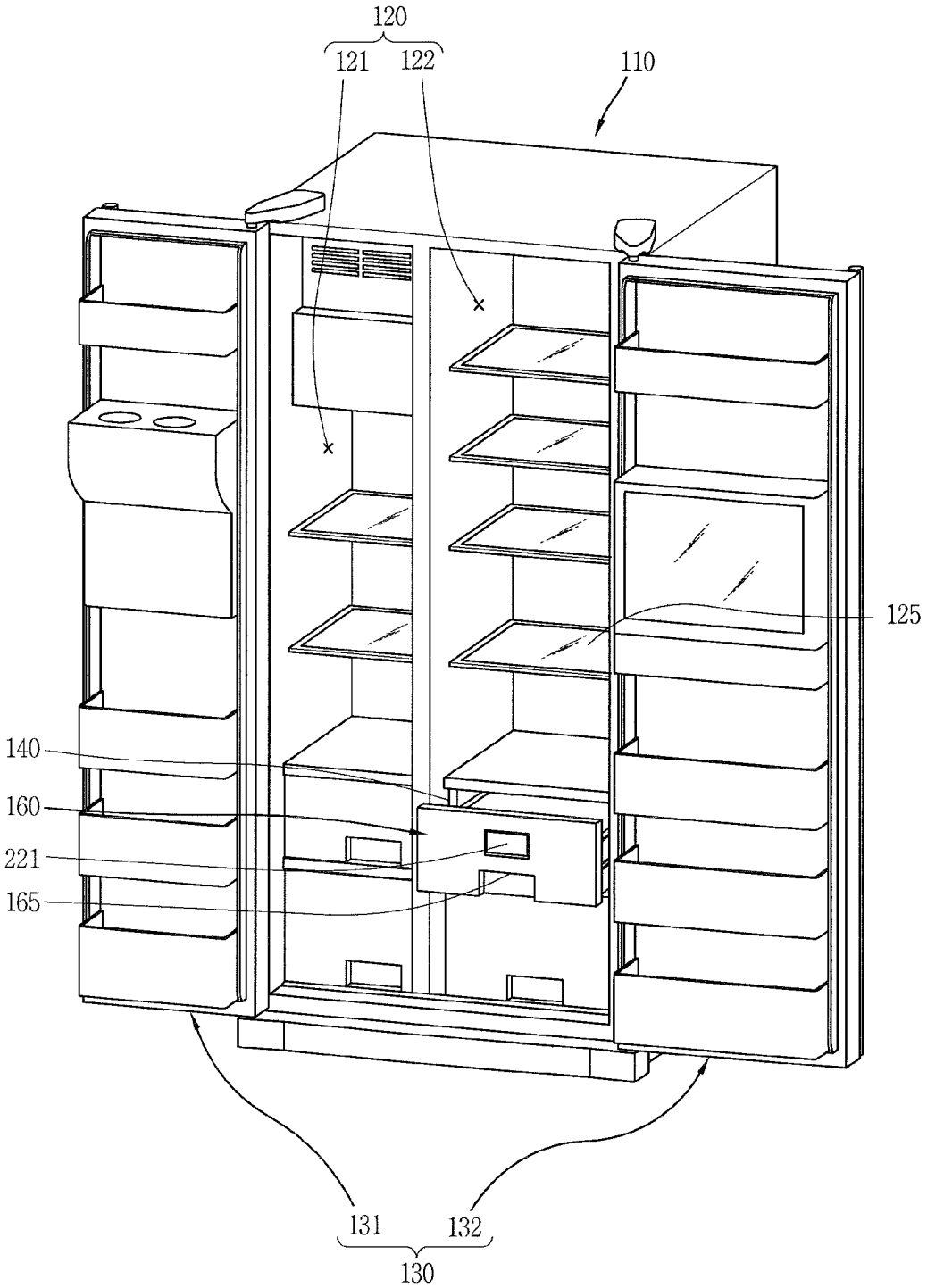
FIG. 6 is a perspective view illustrating a refrigerator with a vegetable chamber in accordance with one exemplary embodiment of the present disclosure.
Figure 7:
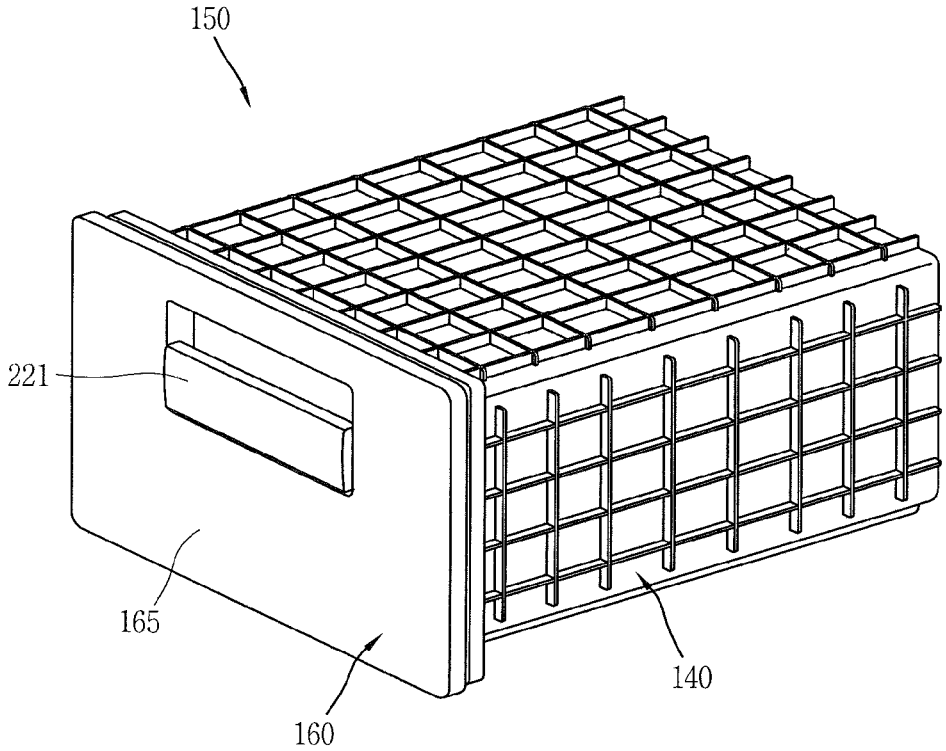
FIG. 7 is a perspective view of the vegetable chamber in accordance with one exemplary embodiment of the present disclosure.
Figure 8:
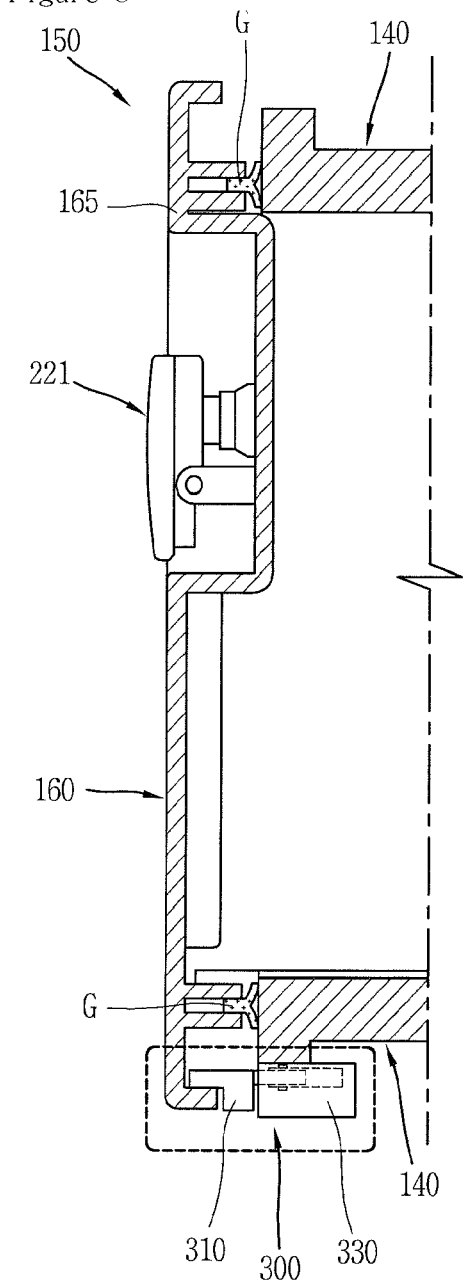
FIG. 8 is a sectional view illustrating a closed state of a drawer door of FIG. 7.

As illustrated in FIGS. 6 to 8, a refrigerator having a drawer sealing apparatus in accordance with one exemplary embodiment may include a refrigerator main body 110 having a cooling chamber 120 providing a storage space, a case 140 disposed within the cooling chamber and forming an accommodating space with a front opening, a drawer 160 accommodated in the case 140 to be drawn out, a drawer door 165 for closing the front opening of the case 140 as the drawer 160 is pushed in, and a sealing apparatus 300 having a drawer side member 310 disposed on the drawer door 165 and a case side member 330 disposed on the case 140.

The refrigerator main body 110 may further include a cooling chamber door 130 for opening and closing the cooling chamber 120. The cooling chamber 120 may be partitioned into a freezing chamber 121 and a refrigerating chamber 122. Here, the arrangement of the freezing chamber 121 and the refrigerating chamber 122 may not be limited to that illustrated. The chambers may also be vertically arranged, or a case including a plurality of freezing chambers and refrigerating chambers may also be taken into account.

The cooling chamber door 130 may include a freezing chamber door 131 for opening and closing the freezing chamber 121, and a refrigerating chamber 132 for opening and closing the refrigerating chamber door 132. A plurality of shelves 125 may be disposed within the refrigerating chamber 122, and the drawer 160 may be installed in one or more of the plurality of shelves 125. Here, the drawer may be, as illustrated, installed in plurality or only one drawer may also be provided.

The drawer 160 may be accommodated within the case 140 to be drawn out. The case 140 may have the front opening facing the front of the refrigerating chamber 122. Accordingly, the drawer 160 may be drawn out and accommodated along back and forth directions of the refrigerating chamber 122.

The case 140 may have a rectangular parallelepiped shape with the front surface open. A flange 143 may externally extend from the front surface of the case 140. Here, the case 140, for example, may be made of synthetic resin.

A plurality of ribs may be formed on an outer surface of the case 140 to improve rigidity of the case 140. Meanwhile, the refrigerator may include a de-compressor system or a pump (not shown) for decompressing the inside of the case 140.

The drawer 160 may include an accommodating portion for receiving foods, and a front portion disposed at the front of the accommodating portion. A drawer door 165 may be formed on the front portion. The drawer door 165 may extend from the accommodating portion to close the front opening of the case 140.

The drawer door 165 may come in contact with the flange 143 formed on an edge of the front opening of the case 140. Here, the drawer door 165 may have a rectangular parallelepiped shape to correspond to the front opening of the case 140.

A gasket G as a sealing member may be disposed between the drawer 160 and the case 140. Here, the gasket G may be fixed to one of the drawer 160 or the case 140.

The gasket G may come in contact with the flange 143 as the front opening of the case 140 to block a gap between the drawer door 165 and the case 140, thereby sealing an inner space.

The gasket G, for example, may be formed of rubber.

The gasket G may have a closed loop shape (a shape similar to a rectangular ring).

Meanwhile, referring to FIG. 8, a sealing apparatus 300 may be disposed at the drawer 160 and the case 140. The sealing apparatus 300 may allow the inner space of the drawer 160 and the case 140 to be hermetically sealed from the exterior when the drawer 160 is accommodated in the case 140.

The sealing apparatus 300 may be provided with a drawer side member 310 disposed on the drawer door 165 and a case side member 330 disposed on the case 140.

The sealing apparatus 300 may have a sealing position where the drawer side member 310 and the case side member 330 are engaged with each other to maintain the sealed state when the drawer door 165 is closed, and an unsealing position where the drawer side member 310 and the case side member 330 are separated from each other when the drawer door 165 is open.

Figure 9:
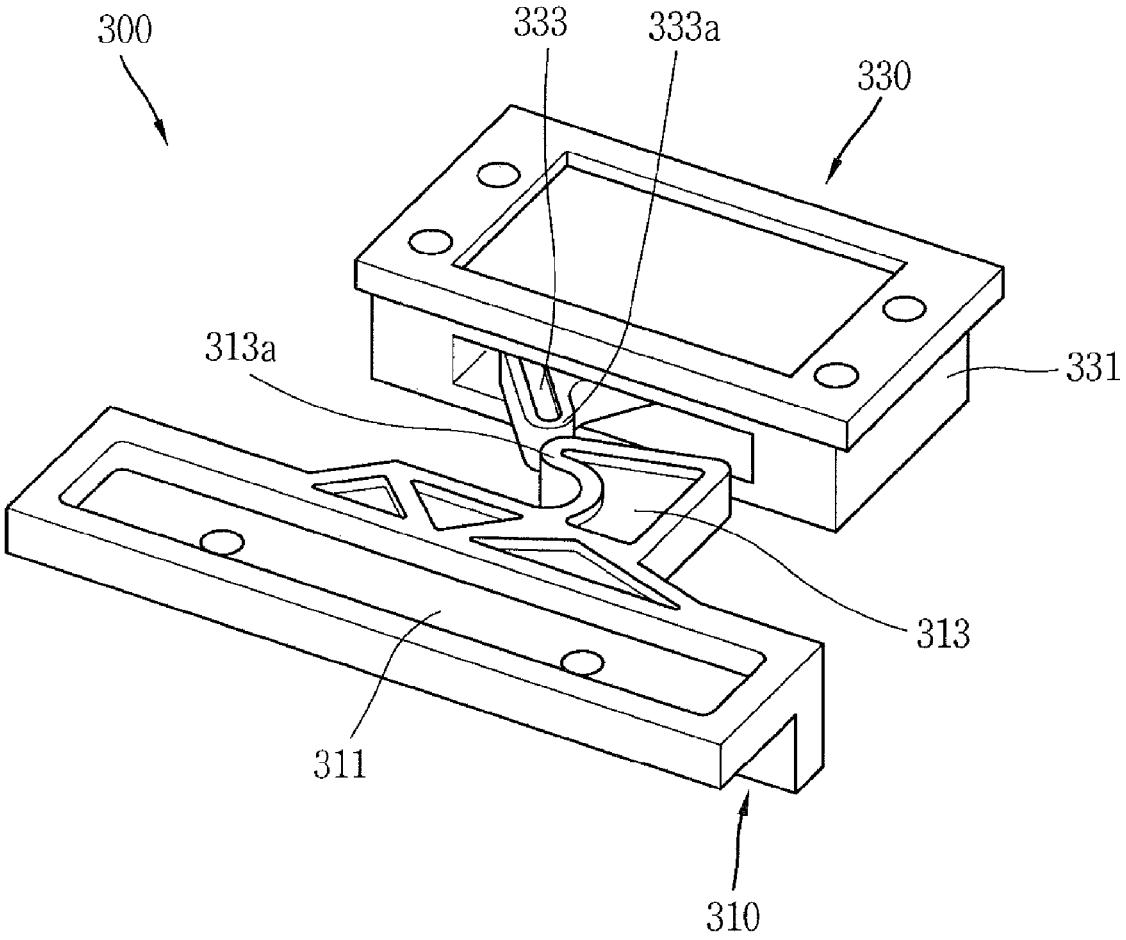
FIG. 9 is a perspective view illustrating a sealing apparatus for the vegetable chamber of the exemplary embodiment.

Referring to FIG. 9, the drawer side member 310 may include a drawer fixing portion 311 fixed to a lower portion of the drawer door 165, and a fixing hook 313 disposed at the drawer fixing portion 311.

The sealing apparatus 300 may improve a sealing force by pulling on the drawer in a closing direction when the drawer is closed, by allowing the drawer side member 310 and the case side member 330 to be engaged with each other while being fixed to the lower portion of the drawer door 165 and a lower portion of the case 140, respectively.

The case side member 330 may include a case fixing holder 331 fixed to the lower portion of the case 140, and a movable hook 333 mounted in the case fixing holder 331 to be hinge-rotated.

Figure 10A:
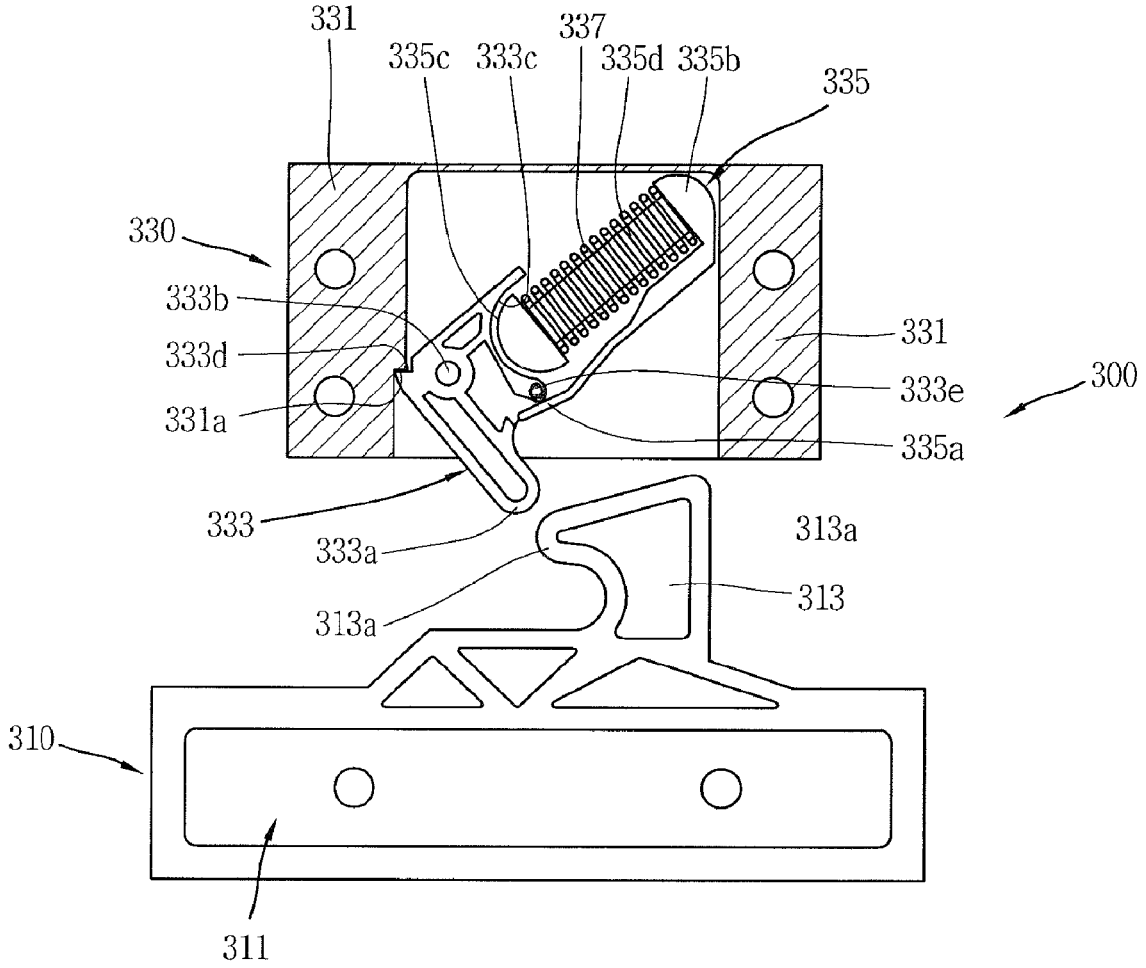
FIG. 10A is a planar sectional view illustrating a state that the drawer is located at an unsealing position.
Figure 10B:
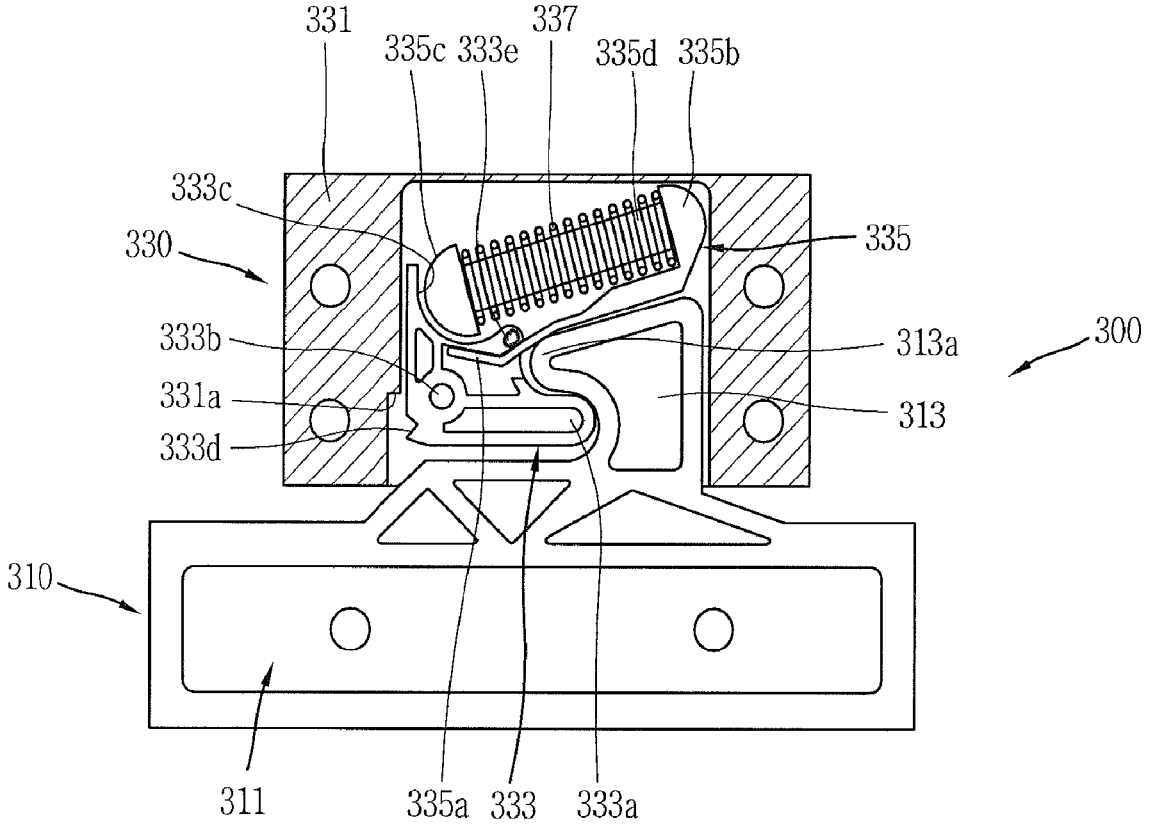
FIG. 10*b* is a planar sectional view illustrating a state that the drawer is located at a sealing position.

Referring to FIGS. 9, 10*a* and 10*b*, the case fixing holder 331 may serve as a housing in which components such as the movable hook 333 and a telescopic member 335 are assembled.

FIG. 10A is a planar sectional view illustrating in detail an unsealed position as an open state of the drawer, and FIG. 10*b* is a planar sectional view illustrating in detail a sealed position as a closed state of the drawer.

As illustrated in FIGS. 10A and 10B, the movable hook 333 may be hinge-rotated to be stopped when being engaged with the fixing hook 313 in the sealing position, and hinge-rotated to be released from the fixing hook 313 in the unsealing position.

The movable hook 333 may include a hook hinge 333*b* fixed to the case fixing holder 331.

The movable hook 333 may preferably be made of plastic with high rigidity into a shape of plate similar to a shape of "⌊."

The hook hinge 333*b* may be formed on a central corner of the "⌊"-shaped movable hook 333. The hook hinge 333*b* may be fixed within the case fixing holder 331 such that the movable hook 333 can be rotated about the hook hinge 333*b* within a predetermined angle.

A stopping hook 333*a* engaged with the fixing hook 313 may be formed on a left end portion of the movable hook 333. Also, a hook stopping jaw 331*a* may be formed on the movable hook 333 on an opposite side of the stopping hook 333*a*.

Accordingly, the movable hook 333 may be rotated centering on the hook hinge 333*b* such that the stopping hook 333*a* formed on the end portion thereof can be coupled to a stopping portion 313*a* formed on the fixing hook 313.

Still referring to FIGS. 10A and 10B, the case side member 330 may include a hinge shaft 335*b* disposed on one end thereof and fixed to the case fixing holder 331, and a telescopic member 335 disposed on the other end thereof and contactable with the movable hook 333.

One end of the telescopic member 335, as illustrated in FIGS. 10A and 10B, may preferably be hinge-fixed to an inner edge of the case fixing holder 331.

The telescopic member 335 may include a telescopic rod 335*d* which is expanded in the sealing position and contracted in the unsealing position.

The telescopic rod 335*d* may be formed such that two pipes with different diameters are inserted into a shape of telescope so as to be expendable and contractible.

The movable hook 333 and the telescopic member 335 may include engagement curved portions 333*c* and 335*c* on contact portions therebetween, respectively. This may allow one end portion of the telescopic member 335 to be smoothly slidable in a contact state with the movable hook 333.

In detail, the dome-like curved portion 335*c* may be formed on a left end of the telescopic member 335. The engagement curved portion 333*c* which is recessed to accommodate the curved portion 335*c* of the telescopic member 335 so as to be rollable thereon may be formed on an upper side of the movable hook 333.

The telescopic member 335 and the movable hook 333 may cooperatively be rotated centering on the hinge shaft 335*c* and the hook hinge 333*b*, respectively. During the cooperative rotation, a length of the telescopic member 335 may change.

The telescopic member 335 may be expanded when it is located at the sealing position as illustrated in FIG. 10B, and contracted when it is located at the unsealing position as illustrated in FIG. 10A.

Here, the case side member 330 may include a spring 337 having an elastic restoring force to control the expansion and contraction of the telescopic rod 335*d*. The spring 337 may allow one end portion of the telescopic rod 335*d* to be maintained in the contact state with the movable hook 333.

Also, the telescopic rod 335*d* may be mounted in the spring 337. Both ends of the spring 337 may preferably be locked at both end portions of the telescopic member 335 to have an elastic restoring force in an expanding direction.

That is, the spring 337 may have the elastic restoring force in a direction that the telescopic rod 335*d* is expanded. Referring to FIG. 10A, the both ends of the spring 337 may be locked in stopping jaws formed on the both end portions of the telescopic member 335.

Accordingly, the spring 337 may have the elastic restoring force toward being expanded in a lengthwise direction. The spring 337 may have a greater elastic restoring force when the drawer is open to be unsealed as illustrated in FIG. 10A, and have a smaller elastic restoring force when the drawer is closed to be sealed as illustrated in FIG. 10B.

Since the elastic restoring force of the spring 337 is, of course, apt to move in a direction from having the greater elastic restoring force to the smaller elastic restoring force, the movable hook 333 may be affected by a force applied toward the sealing position in a state where an external force is separately applied. Accordingly, the movable hook 333 may pull on the fixing hook 313 fixed to the drawer door 165 so as to allow for maintenance of the sealing force.

Meanwhile, the telescopic member 335 may include a movable hook pressing member 335*a* pressed by the fixing hook 313 upon being engaged into the sealing position so as to hinge-rotate the movable hook 333.

The movable hook 333 may include a rotation pressing protrusion 333*e* pressed by the movable hook pressing member 335*a* such that the movable hook 333 can be rotated based on the hook hinge 333*b*.

The rotation pressing protrusion 333*e* may be located with being spaced from the hook hinge 333*b* of the movable hook 333. Accordingly, the rotation pressing protrusion 333*e* may receive a rotation moment by the movable hook pressing member 335*e* so as to rotate the movable hook 333.

Preferably, the movable hook pressing member 335*a* may have a shape of elastic bar having one end fixed to the hinge shaft 335*b* of the telescopic member 335, and the other end coming in contact with the rotation pressing protrusion 333*e*.

The movable hook pressing member 335*a* may be made of plastic having high rigidity, and preferably be formed as a member which is not easily bent or broken by a pressing force from a lower side.

When the drawer is closed, the movable hook pressing member 335*a* may allow the rotation pressing protrusion 333*e* to be inwardly moved. This may prevent the rotation pressing protrusion 333*e* from being separated from the movable hook pressing member 335*a*.

In accordance with another exemplary embodiment, the case fixing holder 331 may include a hook stopping jaw 331*a*, and the movable hook 333 may include a holder stopping jaw 333*d*.

Referring to FIGS. 10A and 10B, the hook stopping jaw 331*a* and the holder stopping jaw 333*d* may come in contact with each other in the unsealing position, to limit a rotation range of the movable hook 333. This may allow the movable hook 333 to stay at the unsealing position, as illustrated in FIG. 10A.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator having a drawer sealing apparatus comprising:

a refrigerator main body having a cooling chamber;

a case disposed within the cooling chamber and forming an accommodation space with a front opening;

a drawer accommodated in the case and having a drawer door to open and close the front opening of the case; and a sealing apparatus comprising a drawer side member disposed on the drawer door and a case side member disposed on the case, the sealing apparatus having a sealing position where the drawer side member and the case side member are engaged with each other to maintain a sealed state when the drawer door is closed, and an unsealing position where the engaged state is released when the drawer door is open, wherein the drawer side member comprises a drawer fixing portion fixed to a lower portion of the drawer door, and a fixing hook disposed at the drawer fixing portion, wherein the case side member comprises a case fixing holder fixed to a lower portion of the case, and a movable hook mounted on the case fixing holder to be hinge-rotated, and wherein the movable hook is rotated to be stopped by the fixing hook when engaged with the fixing hook in the sealing position, and rotated to be released from the fixing hook in the unsealing position.

2. The refrigerator of claim 1, wherein the movable hook comprises a hook hinge fixed to the case fixing holder, and wherein the movable hook is rotated centering on the hook hinge as a shaft such that a stopping hook formed on an end portion of the movable hook couples to a stopping portion formed on the fixing hook.

3. The refrigerator of claim 1, wherein the case side member comprises a hinge shaft formed on one end thereof and fixed to the case fixing holder, and a telescopic member formed on the other end thereof and contactable with the movable hook, and wherein the telescopic member comprises a telescopic rod expanded in the sealing position and contracted in the unsealing position.

4. The refrigerator of claim 3, wherein the movable hook and the telescopic member comprise engagement curved portions, respectively, on contact portions therebetween, and wherein the telescopic member is rotated to be expanded and contracted in response to the hinge-rotation of the movable hook.

5. The refrigerator of claim 3, wherein the case side member comprises a spring configured to allow one end portion of the telescopic rod to be maintained in a contact state with the movable hook.

6. The refrigerator of claim 5, wherein the telescopic rod is mounted in the spring, and both ends of the spring are locked at both end portions of the telescopic member to have an elastic restoring force in an expanding direction of the telescopic member.

7. The refrigerator of claim 3, wherein the telescopic member comprises a movable hook pressing member configured to press the fixing hook to hinge-rotate the movable hook when being engaged into the sealing position.

8. The refrigerator of claim 7, wherein the movable hook pressing member is an elastic bar having one end fixed to the hinge shaft of the telescopic member and the other end contactable with the rotation pressing protrusion.

9. The refrigerator of claim 8, wherein the movable hook pressing member allows the rotation pressing protrusion to be moved inwardly when the drawer is closed.

10. The refrigerator of claim 3, wherein the case fixing holder comprises a hook stopping jaw and the movable hook comprises a holder stopping jaw, and wherein the hook stopping jaw and the holder stopping jaw come in contact with each other when the drawer is drawn out to be located in the unsealing position, so as to limit a rotation range of the movable hook.

* * * * *